US010577726B2

(12) United States Patent
Tao et al.

(10) Patent No.: US 10,577,726 B2
(45) Date of Patent: Mar. 3, 2020

(54) BIO-BASED DEGRADABLE KNITTED FABRIC WITH ANTIBACTERIAL EFFECT

(71) Applicant: The Hong Kong Research Institute of Textiles and Apparel Limited, Hong Kong (HK)

(72) Inventors: Xiaoming Tao, Hong Kong (HK); Shirui Liu, Hong Kong (HK); Lijuan Liang, Hong Kong (HK); Xinxin Huang, Hong Kong (HK)

(73) Assignee: The Hong Kong Research Institute of Textiles and Apparel Limited, Hong Kong (HK)

( * ) Notice: Subject to any disclaimer, the term of this patent is extended or adjusted under 35 U.S.C. 154(b) by 294 days.

(21) Appl. No.: 15/643,531

(22) Filed: Jul. 7, 2017

(65) Prior Publication Data

US 2018/0010265 A1 Jan. 11, 2018

(30) Foreign Application Priority Data

Jul. 8, 2016 (CN) ..... 2016 1 0541297

(51) Int. Cl.
*D01F 1/10* (2006.01)
*D04B 21/16* (2006.01)
(Continued)

(52) U.S. Cl.
CPC ..... *D01F 6/84* (2013.01); *D01F 1/10* (2013.01); *D02G 3/22* (2013.01); *D02G 3/449* (2013.01); *D04B 21/12* (2013.01); *D04B 21/16* (2013.01); *D01F 6/625* (2013.01); *D10B 2401/021* (2013.01); *D10B 2401/041* (2013.01); *D10B 2401/12* (2013.01); *D10B 2401/13* (2013.01); *D10B 2403/011* (2013.01); *D10B 2403/02* (2013.01)

(58) Field of Classification Search
USPC ..... 442/308, 312; 66/196, 202
See application file for complete search history.

(56) References Cited

U.S. PATENT DOCUMENTS 5,735,145 A * 4/1998 Pernick ..... D04B 1/16 66/196
5,778,702 A * 7/1998 Wrightenberry ..... A41B 11/005 2/239

(Continued)

FOREIGN PATENT DOCUMENTS

CN 104260538 A 1/2015
CN 104757724 A 7/2015

(Continued)

*Primary Examiner* — Jenna L Johnson

(57) ABSTRACT

A biodegradable antibacterial knitted fabric, a cross section of the knitted fabric includes a front side of cross section made of wool short fiber yarns, an intermediate connection layer of cross section capable of transferring moisture and a rear side of cross section made of antibacterial filaments; the intermediate connection layer of cross section is made of filament yarns having a special shape capable of being inserted into the front side of cross section and the rear side of cross section so that the front side of cross section is connected with the rear side of cross section. The biodegradable antibacterial knitted fabric proposed by the present application has a long time significant antibacterial effect by adopting a cross section structure with three layers and antibacterial material, and does not contain any antimicrobials and metal ions, and has the advantages of low cost, easy manufacturing and long lasting antibacterial effect.

6 Claims, 2 Drawing Sheets

Cross section 100 of the biodegradable antibacterial knitted fabric

(51) Int. Cl.

| | |
|---|---|
| ***D04B 21/12*** | (2006.01) |
| ***D01F 6/62*** | (2006.01) |
| ***D01F 6/84*** | (2006.01) |
| ***D02G 3/22*** | (2006.01) |
| ***D02G 3/44*** | (2006.01) |

(56) References Cited

U.S. PATENT DOCUMENTS

| | | | | |
|---|---|---|---|---|
| 6,306,483 | B1 * | 10/2001 | Bessey | B29C 51/004 428/175 |
| 6,884,505 | B2 * | 4/2005 | Shoemaker | D01D 5/253 428/364 |
| 7,169,720 | B2 * | 1/2007 | Etchells | A43B 1/0045 442/239 |
| 7,361,803 | B2 * | 4/2008 | Miskie | A61F 13/505 604/378 |
| 7,465,683 | B2 * | 12/2008 | McMurray | D04B 21/04 442/152 |
| 7,937,973 | B2 * | 5/2011 | Sorensen | A61F 13/04 66/196 |
| 2014/0171890 | A1 | 6/2014 | Rubinsky | |

FOREIGN PATENT DOCUMENTS

| | | | | |
|---|---|---|---|---|
| GB | 2353048 | A * | 2/2001 | A47C 27/006 |
| WO | 2008140337 | A1 | 11/2008 | |

* cited by examiner

Cross section 100 of the biodegradable antibacterial knitted fabric

Knitting structure 200 of the biodegradable antibacterial knitted fabric

The inside antimicrobial effect 300 of the biodegradable antibacterial knitted fabric

BIO-BASED DEGRADABLE KNITTED FABRIC WITH ANTIBACTERIAL EFFECT

CROSS REFERENCE TO RELATED APPLICATIONS

The present application claims the benefit of Chinese Patent Application No. 201610541297.1 filed on Jul. 8, 2016. All the above are hereby incorporated by reference.

TECHNICAL FIELD

The present application relates to the field of textile technology, and more particularly to a biodegradable antibacterial knitted fabric.

BACKGROUND OF THE INVENTION

In the 21st century with low carbon, people are more inclined to the more malleable, breathable, fashionable and soft clothing. However, people wear various kinds of clothes in daily life, study and work and come into contact with many kinds of bacteria. Because of its water seepage and ventilation shape and polymer physical structure, clothing will breed a lot of harmful micro-organisms. Therefore, it is urgent for us to develop antibacterial clothing to protect people's health. A lot of attentions have been paid to the recycling of resources in modern society, and the green production has been realized by the emergence of biodegradable products.

At present, more and more attention has been paid to the use of control techniques to produce antibacterial clothing. The patent CN104260538A discloses a cotton fabric that uses a hydrophobic coating. The fabric consists of a base layer and an antibacterial layer. The antimicrobial layer is made of nano-silver fiber material which is intertwined with better antibacterial effect. However, the antimicrobial durability of this nano-silver fiber material is short and it is expensive.

The Patent CN104757724A discloses a moisture-absorbent quick-drying knitted fabric in which the chitosan/cotton fiber is the outer layer and the polypropylene fiber as the inner layer. The blending ratio of chitosan and cotton fiber is 20:80, and the inner polypropylene fiber layer is made of 75D/72F DTY polypropylene fiber. The chitosan and cotton fiber have strong moisture absorption, combined with the natural wetting function of polypropylene fibers, making the moisture of the inner polypropylene fiber smoothly transferred to the outer layer so that the inner layer remains dry and comfortable. This application has a fast drying property and the chitosan fiber is a natural antimicrobial material, so that this application also has an additional natural antibacterial function. However, the complexity of the production process, the complex manufacturing process, high cost of raw materials and the choice of relatively narrow range of raw materials and other shortcomings limit its wide range of applications in the field of textile materials.

The patent US 2014/0171890A1 discloses a method for producing an antibacterial fabric. By adding a nano silver particle to the bamboo pulp, it has antibacterial properties. The method can be widely used for mattresses, clothes, bed sheets, fabrics, etc. However, this application also has some drawbacks such as poor durability of the antibacterial properties of the fabric, and the silver nanoparticles have a certain influence on the health of the consumer.

The patent WO2008140337A1 discloses fabrics having antibacterial antistatic and ultraviolet properties. Similarly, there is a problem of poor antibacterial durability of the fabric, and the production process will produce pollution, which do not meet the theme of contemporary green production.

SUMMARY OF THE INVENTION

Aiming at problems of the processing technology of the existing antibacterial fabric that the antimicrobial durability is short and the pollution is produced in the production process after using chemical substances or adding silver ions, the present application proposes an antibacterial biodegradable knitted fabric, a cross section includes a front side of cross section made of wool short fiber yarns, an intermediate connection layer of cross section capable of transferring moisture and a rear side of cross section made of antibacterial filaments; the intermediate connection layer of cross section is made of filament yarns having a special shape capable of being inserted into the front side of cross section and the rear side of cross section so that the front side of cross section is connected with the rear side of cross section forming a double-sided fabric with different yarn and effect on each side.

The biodegradable antibacterial knitted fabric according to the present application, wherein, the biodegradable antibacterial knitted fabric adopts a compound knitting structure with six rows.

The biodegradable antibacterial knitted fabric according to the present application, wherein, a first row and a fourth row of the compound knitting structure with six rows consist of the front side of cross section, a second row and a fifth row consist of the rear side of cross section, and a third row and a sixth row consist of the intermediate connection layer of cross section.

The biodegradable antibacterial knitted fabric according to the present application, wherein, the front side of cross section forms an outside of a knitted clothing; the rear side of cross section forms an inside of the knitted clothing; the intermediate connection layer of cross section forms a middle part of the knitted clothing; the intermediate connection layer of cross section is configured to connect the outside and the inside of the knitted clothing and transfer the moisture.

The biodegradable antibacterial knitted fabric according to the present application, wherein, the front side of cross section can use wool short fiber materials, the intermediate connection layer of cross section is made of filament yarns having a special shape and the filament yarns are made of fabric that is made of blended fibers of a copolymer of antibacterial functional polylactic acid and poly 3-hydroxybutyrate-co-3-hydroxyvalerate; the rear side of cross section is made of fabric that is made of blended fibers of a copolymer of antibacterial functional polylactic acid and poly 3-hydroxybutyrate-co-3-hydroxyvalerate.

The biodegradable antibacterial knitted fabric according to the present application, wherein, the antibacterial filaments may be one of synthetic filament yarns, natural fibers and chemical fiber blended yarns, and the filament yarns of the intermediate connection layer for transferring moisture may be one of polylactic acid filament yarns and Sirofil spun yarns.

The biodegradable antibacterial knitted fabric according to the present application, wherein, in the biodegradable antibacterial knitted fabric, a bactericidal rate of white *Candida albicans* (CA) is more than 99% and a bactericidal rate of *Staphylococcus aureus* (SA) and *Streptococcus pyogenes* (SP) is more than 99.97.

The Beneficial Effect of the Invention

The traditional antibacterial fabric achieves the effect of antibacterial by using chemicals or adding silver ions, which has an adverse effect on the health of consumers. The antibacterial effect of these methods will not last long. Some antibacterial drugs are added to the treatment of antibacterial fabrics, which can cause a certain degree of pollution to fibers and fabrics, or the cost of raw materials for conventional antimicrobial fabrics is too high, which limits the use of antibacterial fabrics. Compared with the traditional technology, the biodegradable antibacterial knitted fabric proposed by the present application has a long time significant antibacterial effect by adopting a cross section structure with three layers and antibacterial material, and it does not contain any antimicrobials and metal ions, and has the advantages of low cost, easy manufacturing and long lasting antibacterial effect.

BRIEF DESCRIPTION OF THE DRAWINGS

A further description of the present invention will be provided in conjunction with the drawings and embodiments, in the drawings.

EMBODIMENT OF THE INVENTION

Figure 1:
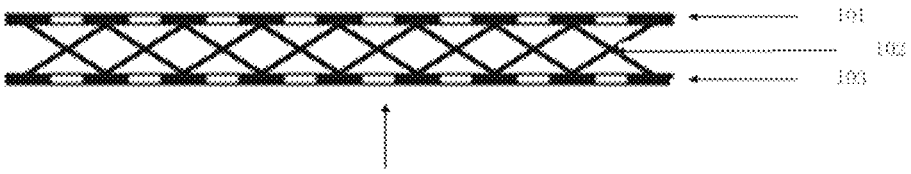
FIG. 1 is a cross-sectional view of a biodegradable antibacterial knitted fabric in the present application.
Figure 2:
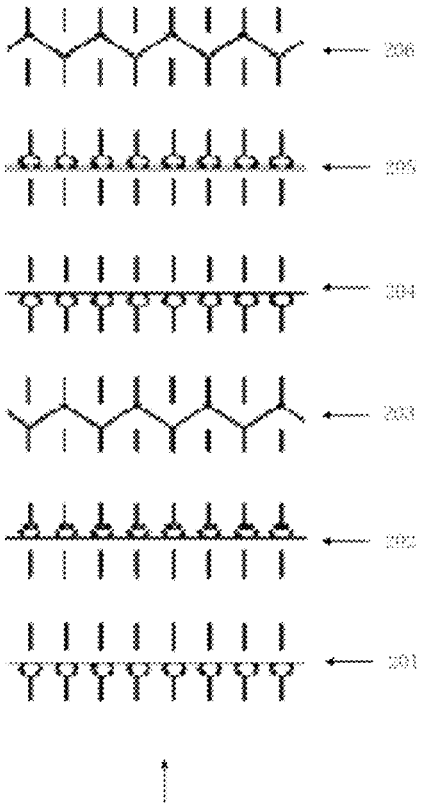
FIG. 2 is a schematic diagram of a knitted fabric of the biodegradable antibacterial knitted fabric in the present application.

FIG. 1 is the cross section 100 of the biodegradable antibacterial knitted fabric in the present application. FIG. 2 is a schematic diagram of a knitted structure 200 of the biodegradable antibacterial knitted fabric in the present application. Please refer to FIG. 1-FIG. 2, the cross section 100 of the biodegradable antibacterial knitted fabric includes three parts, the front side of cross section 101, the intermediate connection layer 102 and the rear side of cross section 103. The front side of cross section 101 is made of wool type short fiber yarns and is configured to form an outside of knitted clothing. The intermediate connection layer of cross section 102 has a special physical structure, such as a clover structure, capable of being inserted into the front side of cross section 101 and the rear side of cross section 103 of the knitted fabric. The intermediate connection layer of cross section 102 is used to connect the front side of cross section 101 and the rear side of cross section 103 of the knitted fabric, and is capable of transferring moisture. The rear side of cross section 103 is made of antibacterial filaments.

The intermediate connection layer of cross section 102 of the biodegradable antibacterial knitted fabric is made of filament yarns having a special shape made of antibacterial materials. The special physical structure, such as a clover structure, making the front side of cross section 101 connected with the rear side of cross section 103. The antibacterial materials adopt blended fibers of a copolymer of antibacterial functional polylactic acid and poly 3-hydroxybutyrate-co-3-hydroxyvalerate. The intermediate connection layer of cross section 102 has not only a connection function but also an antibacterial and hydrophobic function. The rear side of cross section 103 is made of antibacterial filaments adopting blended fibers of a copolymer of antibacterial functional polylactic acid and poly 3-hydroxybutyrate-co-3-hydroxyvalerate, and can achieve the antibacterial function of the knitted fabric.

Please refer to FIG. 2, the biodegradable antibacterial knitted fabric adopts a compound knitting structure with six rows. a first row 201 and a fourth row 204 of the compound knitting structure with six rows 200 consist of the front side of cross section 101, a second row 202 and a fifth row 205 consist of the rear side of cross section 103, and a third row 203 and a sixth row 206 consist of the intermediate connection layer of cross section 102. The intermediate connection layer of cross section 102 is used to connect the front side of cross section 101 made of wool short fiber and the rear side of cross section 103 made of antibacterial filaments, so that the knitting fabric not only has the function of natural wool type short fiber, but also has the antibacterial function of filament fiber yarn.

According to the biodegradable antibacterial knitted fabric of the present application, the front side of cross section 101 forms an outside of a knitted clothing; the rear side of cross section 103 forms an inside of the knitted clothing; the intermediate connection layer of cross section 102 forms a middle part of the knitted clothing; the intermediate connection layer of cross section 102 is configured to connect the outside and the inside of the knitted clothing and transfer the moisture.

The traditional antibacterial fabric achieves the effect of antibacterial by using chemicals or adding silver ions, which has an adverse effect on the health of consumers. The antibacterial effect of these methods will not last long. Some antibacterial drugs are added to the treatment of antibacterial fabrics, which can cause a certain degree of pollution to fibers and fabrics, or the cost of raw materials for conventional antimicrobial fabrics is too high, which limits the use of antibacterial fabrics. The biodegradable antibacterial filament yarn proposed by the present application may be one of synthetic filament yarns, natural fibers and chemical fiber blended yarns, and the filament yarns of the intermediate connection layer for transferring moisture may be one of polylactic acid filament yarns and Sirofilspun yarns. Thus the biodegradable antibacterial knitted fabric proposed by the present application adopting a cross section structure with three layers and antibacterial material has the advantages of low cost, easy manufacturing and long lasting antibacterial effect, and can be applied to ordinary clothing manufacturing, health care fabric, transportation fabric, aerospace fabrics and other fields.

Figure 3:
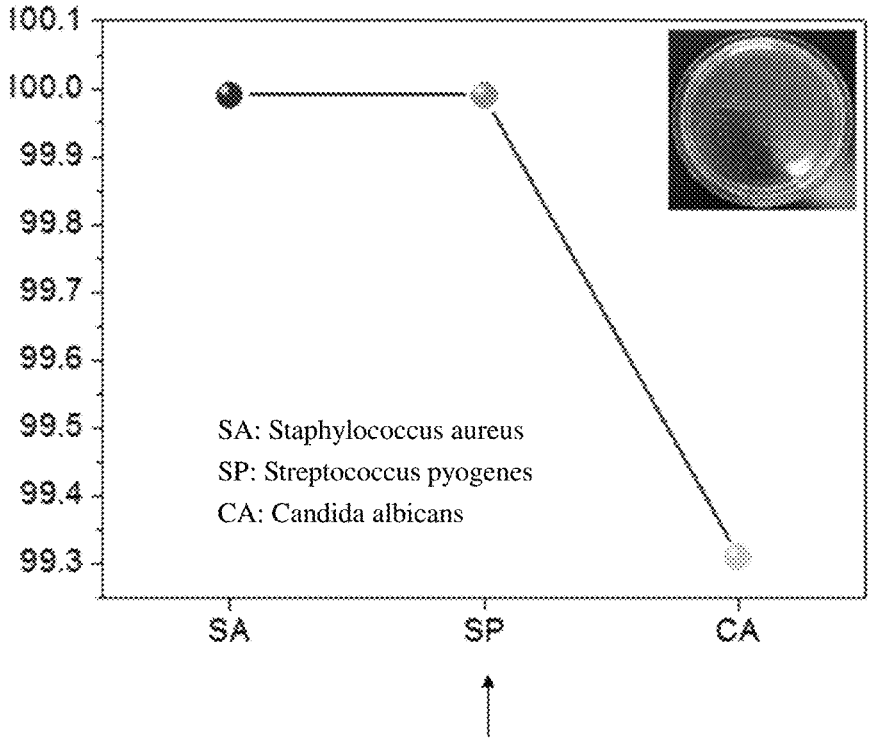
FIG. 3 is a schematic diagram of the antimicrobial effect of the biodegradable antibacterial knitted fabric in the present application.

FIG. 3 is a schematic diagram of the antimicrobial effect of the biodegradable antibacterial knitted fabric in the present application. During the test of the antibacterial effect of the biodegradable antibacterial knitted fabric proposed in the present application, the AATCC100-2012 was used as the antimicrobial resistance test standard, tested using our common bacterial species, and the common bacterial species are used for testing. The *Candida albicans* (CA), the *Staphylococcus aureus* (SA) and the *Streptococcus pyogenes* (SP) are used. As shown in FIG. 3, the inner fabric has an antibacterial effect of over 99% on three common bacteria. Especially antibacterial effect for *Staphylococcus aureus* and *Streptococcus pyogenes* is better, and is more than 99.97%.

While the embodiments of the present invention are described above, it should be understood that it is intended to be exemplary not to be limiting of the present invention. In the inspiration of the present invention, those ordinary skills in the art can also make many modifications without breaking away from the subject of the present invention and the protection scope of the claims. All these modifications belong to the protection of the present invention. Accordingly, the scope of protection of the present invention is limited only to the embodiments described above, but should be defined in accordance with the claims and their equivalents.

The invention claimed is:

1. A biodegradable knitted fabric, wherein, a cross section (100) includes a front side of cross section (101) made of wool staple fiber yarns, an intermediate connection layer of cross section (102) capable of transferring moisture and a rear side of cross section (103) made of antibacterial filaments; the intermediate connection layer of cross section (102) is made of filament yarns having a clover structure capable of being inserted into the front side of cross section (101) and the rear side of cross section (103) so that the front side of cross section (101) is connected with the rear side of cross section (103) forming a double-sided fabric with different yarn and effect on each side.

2. The biodegradable knitted fabric according to claim 1, wherein, the biodegradable knitted fabric adopts a compound knitting structure with six rows (200).

3. The biodegradable knitted fabric according to claim 2, wherein, a first row (201) and a fourth row (204) of the compound knitting structure with six rows (200) consist of the front side of cross section (101), a second row (202) and a fifth row (205) consist of the rear side of cross section (103), and a third row (203) and a sixth row (206) consist of the intermediate connection layer of cross section (102).

4. The biodegradable knitted fabric according to claim 1, wherein, the front side of cross section (101) forms an outside of a knitted clothing; the rear side of cross section (103) forms an inside of the knitted clothing; the intermediate connection layer of cross section (102) forms a middle part of the knitted clothing; the intermediate connection layer of cross section (102) is configured to connect the outside and the inside of the knitted clothing and transfer the moisture.

5. The biodegradable knitted fabric according to claim 1, wherein, the filament yarns are made of a copolymer of antibacterial functional polylactic acid and poly 3-hydroxybutyrate-co-3-hydroxyvalerate; the antibacterial filaments are made of a copolymer of antibacterial functional polylactic acid and poly 3-hydroxybutyrate-co-3-hydroxyvalerate.

6. The biodegradable knitted fabric according to claim 1, wherein, in the biodegradable knitted fabric, a bactericidal rate of white *Candida albicans* (CA) is more than 99% and a bactericidal rate of *Staphylococcus aureus* (SA) and *Streptococcus pyogenes* (SP) is more than 99.97.

* * * * *